United States Patent [19]

Bissonette

[11] 4,002,477

[45] Jan. 11, 1977

[54] DIFFUSION TRANSFER PROCESSES AND ELEMENTS USING OR CONTAINING INERT TRANSITIONAL METAL COMPLEX OXIDIZING AGENTS

[75] Inventor: Vernon Leon Bissonette, Brookport, N.Y.

[73] Assignee: Eastman Kodak Company, Rochester, N.Y.

[22] Filed: Aug. 22, 1975

[21] Appl. No.: 606,999

Related U.S. Application Data

[63] Continuation of Ser. No. 420,193, Nov. 28, 1973, abandoned, and a continuation-in-part of Ser. No. 256,072, May 23, 1972, Pat. No. 3,834,907, and a continuation-in-part of Ser. No. 189,289, Oct. 14, 1971, abandoned, said Ser. No. 256,072, is a continuation-in-part of Ser. No. 150,741, June 7, 1971, abandoned.

[52] U.S. Cl. ..... 96/3; 96/29 D; 96/73; 96/74; 96/77

[51] Int. Cl.[2] ..... G03C 7/00; G03C 5/54; G03C 1/40; G03C 1/76

[58] Field of Search ..... 96/73, 74, 3, 29 D, 96/76 R, 77

[56] References Cited

UNITED STATES PATENTS

| | | | |
|---|---|---|---|
| 2,173,739 | 9/1939 | Weber | 96/55 |
| 2,689,793 | 9/1954 | Weller et al. | 96/55 |
| 2,698,798 | 1/1955 | Land | 96/29 D |
| 2,742,832 | 4/1956 | Salimen | 96/55 |
| 2,750,292 | 6/1956 | Pippel et al. | 96/49 |
| 2,808,329 | 10/1957 | Whitmore | 96/9 |
| 2,998,314 | 8/1961 | Puschel | 96/55 |
| 3,467,520 | 9/1969 | Puschel et al. | 96/53 |
| 3,647,436 | 3/1972 | Bush | 96/3 |
| 3,656,950 | 4/1972 | Bent et al. | 96/55 |
| 3,674,490 | 7/1972 | Matejec | 96/48 R |
| 3,748,138 | 7/1973 | Bissonette | 96/66.3 |
| 3,765,891 | 10/1973 | Travis | 96/55 |
| 3,862,855 | 1/1975 | McGuckin | 96/76 R |

FOREIGN PATENTS OR APPLICATIONS

| | | |
|---|---|---|
| 614,808 | 12/1948 | United Kingdom |

*Primary Examiner*—David Klein
*Assistant Examiner*—Richard L. Schilling
*Attorney, Agent, or Firm*—G. E. Battist

[57] ABSTRACT

An improvement is provided in processes wherein an oxidation-reduction reaction is utilized to form an image. In one aspect of this invention, the improvement comprises employing an oxidizing agent and a reducing agent which undergo imagewise redox reaction in the presence of catalytic material, the oxidizing agent and the reducing agent being so chosen that the reaction products are noncatalytic for the oxidation-reduction reaction. In another aspect of this invention, a substitution inert metal complex is utilized as the oxidant in oxidation-reduction image-forming processes. In a specific aspect, image-transfer film units and processes of forming image records in image-transfer film units are disclosed wherein an inert transition metal complex and a reducing agent, which undergo redox reaction in the presence of a catalytic material, are present during processing of said film unit.

27 Claims, No Drawings

DIFFUSION TRANSFER PROCESSES AND ELEMENTS USING OR CONTAINING INERT TRANSITIONAL METAL COMPLEX OXIDIZING AGENTS

This application is a continuation of U.S. Ser. No. 420,193 filed Nov. 28, 1973, now abandoned, a continuation-in-part of U.S. Ser. No. 189,289 filed Oct. 14, 1971, now abandoned, and a continuation-in-part of U.S. Ser. No. 256,072 filed May 23, 1972, now U.S. Pat. No. 3,834,907, which in turn is a continuation-in-part of U.S. Ser. No. 150,741 filed June 7, 1971, now abandoned.

This invention relates to image formation. In one aspect, it relates to image-formation processes which utilize a redox reaction. In certain other aspects, it relates to image amplification or image replacement. In specific aspects, this divisional application relates to image-transfer film elements and processes.

A variety of image-forming systems have been described in the prior art which utilize redox reactions. Belgian Pat. No. 742,768 of June 8, 1970, describes an image-amplification procedure which features the use of peroxy compounds and reducing agents, such as photographic color-developing agents. However, such redox systems are highly unstable; photographic color-developing agents are oxidized merely in the presence of air and peroxy compounds react extremely rapidly with such reducing agents. Hence, it would be desirable to provide image-forming redox systems in which the oxidizing and reducing agents are more stable.

Sheppard et al, U.S. Pat. No. 3,152,903 issued Oct. 17, 1964, suggest various redox systems which have a physical barrier (e.g., phase separation) to prevent redox reaction. The oxidizing and reducing agents proposed undergo substantially immediate redox reaction in the absence of external catalyst when they are incorporated in an inert solvent solution. There appears to be no disclosure in this patent of a redox system which is stable in the absence of some physical barrier.

British Pat. No. 777,635 published June 26, 1957, suggests photographic bleach baths which contain a cobalt(III) complex and which may contain a reducing agent. However, photographic bleach baths contain a silver halide solvent. In the presence of silver halide solvent, the cobalt complex reacts directly with the silver and does not undergo, to any significant degree, redox reaction with the reducing agent.

Photographic physical-developer solutions are well-known in the art. For example, Dippel et al, U.S. Pat. No. 2,750,292 issued June 12, 1956, describe the formation of dyes simultaneously and in situ with the formation of a metal image during physical development of a photographic element containing a metal image and a photographic coupler, with a solution containing photographic color-developing agent and a reducible metal salt. However, a serious disadvantage with physical developers is that they do not have a high degree of stability. One reason for this instability is that the reaction products of the redox reaction are catalysts for further redox reaction; i.e., the reaction is autocatalytic. It would, accordingly, be desirable to provide a nonautocatalytic oxidizing-reducing agent combination.

Christensen, U.S. Pat. No. 2,517,541 issued Aug. 8, 1950, describes photographic silver halide emulsions containing amounts less than about 0.1% by weight of the wet emulsion of an alkali metal cobalticyanide. The exposed elements contaning this addendum are developed in typical photographic developer solutions. The low concentrations of cobalticyanide proposed probably are necessary to avoid fogging the emulsion. Such low amounts of potassium cobalticyanide would not contribute substantially to image formation via redox reaction, even if there is a redox reaction between the cobalticyanide and the developer in areas where silver is developed. However, it is unlikely that even limited redox reaction occurs, because potassium cobalticyanide does not undergo redox reaction with typical color-developing agents in the presence of predeveloped silver.

It is well-known that polymerization of photopolymers can be initiated by a radical which can be liberated through a light-catalyzed redox reaction. See Rust, "Fast Imaging Systems Using Photopolymers", *Optical Spectra*, March/April, 1968, pp. 41–45 at p. 42. There does not, however, appear to be any suggestion in the art relative to providing a stable reducing agent-oxidizing agent combination which can be catalyzed into a redox reaction with a catalytic material.

British Pat. No. 1,194,581 published June 10, 1970, describes an imaging process in which a photosensitive composition, upon exposure to light, generates nuclei of a metal which is more noble than silver and is catalytic to the electroless deposition of a nonnoble metal. An image is formed by an electroless deposition of nonnoble free metal on the nuclei. There appears to be no disclosure in this patent of a stable redox system which is nonautocatalytic.

In the photographic dye bleach system, such as described in Gaspar, U.S. Pat. No. 2,270,118 issued Jan. 13, 1942, dyes are produced imagewise by treating diffusely dyed layers containing silver images with an acid solution which destroys the dye imagewise in areas where silver is present. The destruction of the dye can be accelerated with various "catalysts", such as phenazine. The reactions in the dye bleach system appear to proceed on a stoichiometric basis. See Mayer et al, U.S. Pat. No. 3,340,060 issued Sept. 5, 1967, column 1, lines 18–21, noting that 4 silver atoms are required to destroy 1 azo dye group. It would be desirable to provide a photographic system which would make more efficient use of silver than in the silver dye bleach process.

British Pat. No. 239,875 published Nov. 5, 1925, describes a photograhic element useful in the diazo process which includes a cobalt(III) metal complex and, optionally, silver halide. This diazo image-forming process is a substitution reaction rather than a redox reaction. Further, the incorporated cobalt(III) complx fogs the silver halide.

There is a need in the art, therefore, for image-forming systems which feature a reducing-oxidizing agent combination which is relatively inert to redox reaction even when in a reactive environment and which do not form reaction products which catalyze the redox reaction. Further, there is need in the art for redox reaction systems which can be utilized to amplify faint images or replace images with other images having a different color value. In addition, it is desirable to provide a method whereby the extremely high light sensitivity of photograhic silver halide can be utilized to generate a latent or faint silver image that acts as a catalyst for a redox system to amplify or replace the silver image.

One object of this invention is to provide a method and composition for forming images.

Another object of this invention is to provide an image-forming method in which a redox reaction is utilized to produce a change in light value.

Still another object of this invention is to provide an image-forming process in which at least one of the reaction products of a redox reaction is utilized to produce a change in light value.

A further object of this invention is to provide a method for amplifying faint or invisible images.

Another object of this invention is to supplement metal images with dye images.

Still another object of this invention is to replace metallic images with dye images.

Another object of this invention is to provide a method for enhancing the quantity of dye formed by the reaction of oxidized color-developing agent with photographic color coupler in systems in which the oxidized developing agent is generated by the reaction of unoxidized color-developing agent with exposed photographic silver halide.

Other objects of this invention will be apparent from the disclosure herein and the appended claims.

In one embodiment of this invention, an improvement is provided in an image-forming process wherein an oxidation-reduction reaction is utilized to form a photographic image, which improvement comprises employing an oxidizing agent and a reducing agent which undergo redox reaction in the presence of catalytic material and which are essentially inert to oxidation-reduction reaction in the absence of a catalytic material, the oxidizing agent and the reducing agent being so chosen that the reaction products thereof are noncatalytic for the oxidation-reduction reaction. This improvement provides a process wherein only very small quantities of a catalyst, such as silver, are needed to produce a high-density image record. This feature is especially desirable in image-transfer elements since the silver is generally not recovered. Thus, color image-transfer records can now be obtained with substantially reduced quantities of silver since the amount of dye which can be found is not directly proportional to the amount of silver formed during development.

In another embodiment of this invention, an improvement is provided in an image-forming process wherein a reaction product of the oxidation-reduction reaction is utilized to form a photographic image, which improvement comprises employing an oxidizing agent and a reducing agent which undergo imagewise redox reaction at a catalytic surface, the oxidizing agent being a complex of a metal ion with ligands which, when a test sample of the complex is dissolved at 0.1 molar concentration at 20° C. in an inert solvent solution containing a 0.1 molar concentration of an uncoordinated ligand, exhibits essentially no exchange of uncoordinated and coordinated ligands for at least 1 minute.

In another embodiment of this invention, a method of forming images is provided which comprises:

1. conducting on a catalytic surface an imagewise oxidation-reduction reaction between an oxidizing agent and a reducing agent, the oxidizing agent preferably being an inert (as described herein) metal complex, and
2. forming an image by chemically combining at least one of the reaction products of the oxidation-reduction reaction with a reactive species to produce a change in light value.

In still another embodiment of this invention, an improvement is provided in a method of forming images in which the ability of an active species to form a change in light value is inhibited imagewise by interaction with a reactant, which improvement comprises forming the reactant as the product of an imagewise oxidation-reduction reaction at a catalytic surface, the reaction products of the oxidation-reduction reaction being noncatalytic for the oxidation-reduction reaction.

In a further embodiment of this invention, an improvement is provided in a method of forming photographic images wherein an aromatic primary amino color-developing agent is oxidized in the development of an exposed photographic silver halide emulsion, and the oxidized color-developing agent reacts with a photographic color coupler to form a dye, which improvement comprises conducting the development in the presence of an oxidizing agent which is so chosen that, under the conditions of the photographic development, it undergoes redox reaction with the color-developing agent in the presence of metallic silver and the combination is substantially kinetically stable in the absence of said metallic silver.

In another embodiment of this invention, the combination of an aromatic primary amino color-developing agent and an oxidizing agent in accordance with this invention is catalyzed into redox reaction by a metallic silver image, and the oxidized color-developing agent is reacted with a photographic color coupler to form a dye. The dye so formed can be transferred to a suitable receiving sheet, or it can supplement or replace the metallic silver image. Dye formation can take place in a photographic element comprising a colloid layer containing a silver image coated on a suitable support. The photographic color coupler can be incorporated in the colloid layer or a colloid layer contiguous the colloid layer containing the silver image, or the coupler can be introduced separately, e.g., with the color-developing agent and oxidizing agent.

In another embodiment of this invention, an oxidizing agent-reducing agent combination in accordance with this invention enters into an imagewise redox reaction upon contact with a metallic silver image, and the reduced form of the oxidizing agent is reacted with a reactive species to form a colored compound. The reactive species can be the oxidized form of certain reducing agents or a component which does not take part directly in the redox reaction.

In another embodiment of this invention, image-transfer film units are provided which comprise direct-positive emulsions and an oxidizing agent as described herein. The addition of many of the preferred oxidizing agents of this invention to conventional, negative developing-out silver halide emulsions results in substantial desensitization. This problem of desensitization is not encountered when the oxidants are added to direct-positive silver halide emulsions.

In a further embodiment of this invention, a photographic film unit is provided comprising:

1. a photosensitive element comprising a support having thereon at least one photosensitive silver halide emulsion layer, each said silver halide emulsion layer having associated therewith an image dye-providing material which is preferably a non-diffusible dye image-providing material capable of reacting with oxidized developing agent to provide an imagewise distribution of diffusible image dye-providing material, such as a preformed image dye or an image dye precursor;

2. a support (which can be the same support used for the photosensitive silver halide emulsion layer) having thereon an image-receiving layer; and
3. a rupturable container containing an alkaline processing composition;

said film unit containing a silver halide developing agent which reacts in its oxidized form with said image dye-providing material to provide a diffusible image dye and an oxidant in accordance with this invention which undergoes imagewise redox reaction with said developing agent in areas where metallic silver develops. The exposed photosensitive element is processed by contacting it with the developing agent and oxidant to provide diffusible dye, and by diffusing the dye to the image-receiving layer. In one useful aspect of this embodiment of the invention, the photosensitive element comprises a support having coated thereon, in sequence, an image-receiving layer, an alkaline solution-permeable, substantially opaque, light-reflective layer and the photosensitive layer thereover; the rupturable container is adapted to be positioned between the photosensitive element, after exposure thereof, and a process sheet adapted to be superposed over the outermost layer of the photosensitive support, so that a compressive force applied to the container will effect a discharge of the contents of the container between the process sheet and the outermost layer of the photosensitive element. The photosensitive portion of the photosensitive element preferably comprises a red-sensitive silver halide emulsion layer having associated therewith a cyan dye image-providing material which can be a nondiffusible coupler capable of reacting with oxidized aromatic primary amino color-developing agent to produce a diffusible cyan dye, a green-sensitive silver halide emulsion layer having associated therewith a magenta dye image-providing material which can be a nondiffusible coupler capable of reacting with oxidized aromatic primary amino color-developing agent to produce a diffusible magenta dye, and a blue-sensitive silver halide emulsion layer having associated therewith a yellow dye image-providing material which can be a nondiffusible coupler capable of reacting with oxidized aromatic primary amino color-developing agent to produce a diffusible yellow dye. The oxidant can be present in the receiving sheet; in the photosensitive element, especially when the photosensitive material is a direct-positive silver halide emulsion; in the alkaline processing composition in the rupturable container; or in a solution in a second rupturable container when the pH of the alkaline processing solution is so high that it decomposes the particular oxidant selected.

In still another embodiment of this invention, processing compositions are provided comprising the oxidation-reduction combination featured in this invention, which are useful in image-transfer film elements.

In accordance with certain embodiments of this invention, a redox reaction between an oxidizing agent and a reducing agent can be utilized to produce a change in light value. This change in light value can come about directly by a change in the light value of either the oxidizing agent or reducing agent. Alternatively, the redox reaction can result in one or more reaction products which can react with each other or with another component, such as a reactive species, to produce a change in light value. In another variation of the invention, the reactivity of the reactive species can be reduced imagewise by one of the reaction products of the redox reaction. In still other embodiments, the redox reaction between the oxidizing agent and the reducing agent will facilitate the formation of an imagewise distribution of a preformed image dye from an initially mobile or initially immobile material.

Oxidants preferred in the practice of this invention are the metal complexes, such as a transition metal complex, e.g., a Group VIII metal complex, or a complex of a metal of Series 4 of the periodic table appearing on pp. 54–55 of Lange's *Handbook of Chemistry*, Eighth Edition, published by Handbook Publisher, Inc., Sandusky, Ohio, 1952. Such complexes feature a molecule having a metallic atom or ion. This metallic ion is surrounded by a group of atoms, ions or other molecules which are generically referred to as ligands. The metallic atom or ion in the center of these complexes is a Lewis acid; the ligands are Lewis bases. Werner complexes are well-known examples of such complexes. The useful metal salts are typically capable of existing in at least two valent states. In a preferred aspect of the invention, the metal complexes are those referred to by American Chemists as "inert" and by European chemists as "robust." Particularly useful are complexes of a metal ion with a ligand which, when a test sample thereof is dissolved at 0.1 molar concentration at 20° C. in an inert solvent solution also containing .1 molar concentration of a tagged ligand of the same species which is uncoordinated, exhibits essentially no exchange of uncoordinated and coordinated ligands for at least 1 min., and preferably for at least several hours, such as up to 5 hr. or more. This test is advantageously conducted under the pH conditions which will be utilized in the practice of the invention. In silver halide photography, this generally will be a pH of over about 8. Many metal complexes useful in this invention show essentially no exchange of uncoordinated and coordinated ligands for several days. The definition of "inert" metal complexes and the method of measuring ligand exchange using radioactive isotopes to tag ligands are well-known in the art; see, for example, Taube, *Chem. Rev.*, Vol. 50, p. 69 (1952), and Basolo and Pearson, *Mechanisms of Inorganic Reactions, A Study of Metal Complexes and Solutions*, Second Edition, 1967, published by John Wiley and Sons, p. 141. Further details on measurement of ligand exchange appear in articles by Adamson et al, *J. Am. Chem. Soc.*, Vol. 73, p. 4789 (1951). The inert metal complexes should be contrasted with labile complexes which, when tested by the method described above, have a reaction half-life of generally less than 1 min. Metal chelates are a special type of mtal complex in which the same ligand (or molecule) is attached to the central metal ion at two or more different points. The metal chelates generally exhibit somewhat slower ligand exchange than nonchelated complexes. Labile-type chelates may have a half-life of several seconds, or perhaps slightly longer. Generally, the oxidizing agents employed are not reduced to a zero valent metal during the redox reaction of the invention.

Preferred metal complexes in accordance with this invention have coordination numbers of 6 and are known as octahedral complexes. Cobalt complexes are especially useful in the practice of this invention. Most square planar complexes (which have a coordination number of 4) are rather labile, although some Group VIII metal square planar complexes, particularly platinum and palladium square planar complexes, exhibit inertness to rapid ligand exchange.

A wide variety of ligands can be used with a metal ion to form suitable metal complexes. Nearly all Lewis bases (i.e., substances having an unshared pair of electrons) can be ligands in metal complexes. Some typical useful ligands include the halides, e.g., chloride, bromide, fluoride, nitrite, water, amino, etc., as well as such common ligands as those referred to on p. 44 of Basolo et al, supra. The lability o the ligands in a complex is influenced by the nature of the ligands selected in forming said complex.

Particularly useful cobalt complexes have a coordination number of 6 and have a ligand selected from the group consisting of ethylenediamine(en), propylenediamine(tn), diethylenetriamine(dien), triethylenetetraamine(trien), amine ($NH_3$), nitrate, nitrite, azide, chloride, thiocyanate, isothiocyanate, water and carbonate. The preferred cobalt complexes comprise (a) at least 2 ethylenediamine ligands or (b) at least 5 amine ligands or (c) 1 triethylenetetraamine ligand or (d) at least 2 propylenediamine ligands. Especially useful are the cobalt hexammine salts (e.g., the chloride, bromide, sulfite, sulfate, perchlorate, nitrite and acetate salts). Some other specific highly useful cobalt complexes include those having one of the following formulas: $[Co(NH_3)_5H_2O]X$, $[Co(NH_3)_5CO_3]X$, $[Co(NH_3)_5\text{-}Cl]X$, $[Co(NH_3)_4CO_3]X$, $[Co(en)_3]X$, cis-$[Co(en)_2(N_3)_2]X$, trans-$[Co(en)_2Cl(NCS)]X$, trans-$[Co(en)_2(N_3)_2]X$, cis-$[Co(en)_2(NH_3)N_3]X$, cis-$[Co(en)_2Cl_2]X$, trans-$[Co(en)_2Cl_2]X$, $[Co(en)_2(SCN)_2]X$ and $[Co(en)_2(NCS)_2]X$, wherein X represents one or more anions determined by the charge neutralization rule. Complexes containing oxidized noble metals of ferromagnetic metals such as complexes of $Co^{III}$, $Fe^{III}$, $Rh^{III}$, $Pt^{IV}$, $Pd^{IV}$ and $Ir^{III}$, which have reactivities similar to the complexes listed above, could be used in the practice of this invention. The redox equilibra published in *Stability Constants of Metal-Ion Complexes*, Sillen and Martell, published by The Chemical Society, Burlington House, London, England (1964), indicate that other complexes have reactivities generally similar to the cobalt complexes mentioned above.

With many complexes, such as cobalt hexammine, the uncoordinated anions selected can substantially effect the reducibility of the complex. The following anions are listed in the order of thoe which give increasing stability to cobalt hexammine complexes: bromide, chloride, nitrite, perchlorate, acetate, carbonate, sulfite and sulfate. Other ions will also effect the reducibility of the complex. These uncoordinated anions should therefore be chosen to provide complexes exhibiting the desired degree of reducibility. Some other uncoordinated anions include hydrochloride, nitrate, thiocyanate, dithionate and hydroxide. Neutral complexes such as $[Co(dien)(SCN)_2OH]$ are useful, but positively charged complexes are generally preferred.

A theory has been advanced to explain the low reactivity between the reducing agent and the central metal ion of the metal complex. It appears that the ligands constitute an effective barrier to reaction between reducing agents and the central metal ion. The barrier may be set up by ligands tightly bound to and surrounding the central metal ion. In the presence of certain catalysts, it seems that one or more of the ligands may be bound less tightly to the central metal ion, thus facilitating reaction between the central metal ion and the reducing agent. However, this inventin is not limited to that theory.

In one preferred embodiment according to this invention where the cobalt(III) ion complexes are incorporated in the photographic element, the anions of the complexes are polyatomic anions, and in some highly preferred embodiments are polyatomic organic anions. The anions are associated with the cobalt(III) ion complex in what may be a salt, an outer sphere complex or an ion pair; see, for example, p. 34 of Basolo et al, supra. Typical useful polyatomic anions include sulfato groups, nitrate, and the like. Typical useful polyatomic organic anions include acetato, propionato, methanesulfonato, benzenesulfonato, hexanesulfonato, and the like. Further details on photographic elements containing these cobalt complexes are disclosed in Mowrey, U.S. Ser. No. 307,891 filed Nov. 20, 1972, which is incorporated hereby by reference.

The polyatomic anions are preferably those which in the sodium salt form are not silver halide solvents; i.e., the sodium salt of the polyatomic anion when employed in an aqueous solution (60° C.) at a 0.02 molar concentration does not dissolve more than 5 times the amount by weight of silver chloride which can be dissolved in distilled water at 60° C. The sodium salts of anions such as thiocyanato and thiosulfato in a 0.02 molar concentration dissolve more than 5 times the amount by weight of silver chloride which is dissolved by distilled water at 60° C.

In another embodiment where the cobalt(III) ion complexes are incorporated in the photographic element, they are incorporated as water-insoluble ion pairs. The use of water-insoluble ion pairs of cobalt(III) ion complexes is described in more detail in Bissonette et al, U.S. Ser. No. 307,894 entitled "Ion-Paired Cobaltic Complexes and Photographic Elements Containing Same", filed Nov. 20, 1972, now U.S. Pat. No. 3,847,619, which is incorporated herein by reference. Generally, these ion pairs comprise a cobalt(III) ion complex ion-paired with an anionic organic acid having an equivalent weight of at least 70 based on acid groups. Preferably the acid groups are sulfonic acid groups.

In certain highly preferred embodiments, the cobalt(III) ion complexes used in this invention contain ammine ($NH_3$) ligands or have a net positive charge which is preferably a net charge of +3. A cobalt(III) ion with six ($NH_3$) ligands has a net charge of +3. A cobalt(III) ion with five ($NH_3$) ligands and one chloro ligand has a net charge of +2. A cobalt(III) ion with two ethylenediamine(en) ligands and two ($N_3$) azide ligands has a net charge of +1. Generally, the best results have occurred where the cobalt(III) complex has a net charge of +3 and/or the cobalt complex contains at least three ammine ligands.

Numerous reducing agents can be utilized in carrying out the present invention. The reducing agents utilized herein undergo redox reaction with the oxidizing agent at a catalytic surface. Especially preferred reducing agents are those which reduce silver halide to metallic silver, such as those which are capable of developing imagewise-exposed light-sensitive photographic silver halide. Depending upon the particular oxidizing agent utilized, the reducing agent can be selected from such reducing agents as hydroquinones, catechols, aminophenols, 3-pyrazolidones such as 1-phenyl-3-pyrazolidone, l-, d- or isoascorbic acid, reductones and phenylenediamines. Dye developers, such as those described and referred to in Rogers, U.S. Pat. No. 2,983,606 issued May 9, 1961, are also reducing agents which are preferably used in combination with an auxiliary developing agent. In certain aspects of the invention, the reducing agent is an aromatic primary amino color-developing agent such as p-aminophenol (which forms particularly stable redox combinations with certain complexes, e.g., $[Co(en_3]Cl_3)$ or p-phenylenediamines. Typical color-developing agents include 3-acetamido-4-amino-N,N-diethylaniline, p-amino-N-ethyl-N-(β-hydroxyethyl)aniline sulfate, p-aminoethyl-β-hydroxyaniline, N,N-diethyl-p-phenylenediamine, 2-amino-5-diethylaminotoluene, N-ethyl-N-(β-methanesulfonamidoethyl)-3-methyl-4-aminoaniline, 4-amino-N-ethyl-3-methyl-N-(β-sulfoethyl)aniline, 4-amino-N-ethyl-(2-methoxyethyl)-m-toluidine di-p-toluenesulfonate, 4-amino-N-butyl-N-γ-sulfobutyl aniline, 4-amino-N,N-diethyl-3-n-propylaniline hydrochloride and the like. See Bent et al, *JACS*, Vol. 73, pp. 3100–3125 (1951), and Mees and James, *The Theory of the Photographic Process*, Third Edition, 1966, published by MacMillan Co., New York, pp. 278–311, for further typical useful developing agents. It will be appreciated that many of the subject reducing agents are most effective at high pH, such as a pH from about 8 to 13.

The reducing agent used in the film units and processes of this invention is preferably a compound which will develop silver halide and/or react in its oxidized form with said image dye-providing material to provide an imagewise distribution of image dye. In thoe instances where dye precursors such as color couplers are used, the reducing agent is preferably a color-developing agent such as primary aromatic amino compound. In certain embodiments where the imagewise pattern of image dye is provided as a function of oxidation of the image dye-providing material, a reducing agent is used which will redox with the image dye-providing material. Typical useful reducing agents of this type include p-methylaminophenol, 2,4-diaminophenol, p-benzylaminophenol, hydroquinone, toluhydroquinone, phenylhydroquinone, 4-methylphenylhydroquinone and the like. Preferably, the reducing agent is a pyrazolidone compound such as 1-phenyl-3-pyrazolidone, 1-phenyl-4-methyl-4-hydroxymethylpyrazolidone and the like. A plurality of reducing agents such as those disclosed in U.S. Pat. No. 3,093,869 can also be used. The reducing agents can be employed in the liquid processing composition or may be contained, at least in part, in any layer or layers of the film unit.

The redox reaction which takes place in the practice of this invention occurs at a catalytic surface, i.e., the reaction environment is a heterogeneous medium wherein the catalyst is in one phase, the oxidant and reductant are in another phase, and the reaction takes place on the interface between the phases. Generally, the catalyst will be a solid material such as metallic silver and the oxidant and the reductant will be in a liquid phase. Any catalytic material can be utilized which initiates and promotes redox reaction between the oxidizing agents and reducing agents selected. While the reaction mechanism is not completely understood, it appears that the catalyst appears to allow electron transfer between the oxidizing agent and the reducing agent. In a preferred embodiment, the catalysts are the zero valent metals or chalcogens of Group VIII or 1B elements. In another embodiment, the catalyst can be an activated carbon or activated charcoal. Many useful catalysts are the zero valent metals or metal nuclei. Specific useful catalysts include metals such as platinum, copper silver, gold and chalcogens such a silver sulfides, silver oxides, nickel sulfide, cuprous sulfide, cobalt sulfide, aurous sulfide and cupric oxide. While several of the catalysts are referred to as chalcogens, it is understood that, in some instances, an equilibrium mixture may be present in the product, such as a mixture of silver hydroxide and silver oxide.

In accordance with this invention, the catalyst appears to provide redox reaction in a true catalytic fashion. The amount of redox reaction is not limited by the amount of catalyst present, since the redox reaction of this invention does not proceed on a stoichiometric basis with respect to the catalyst. Generally, in the absence of the catalyst the oxidant and the reductant can be described as being in a state where they are substantially kinetically stable; i.e., the kinetic reaction is so slow or practically nonexistent as to be not noticeable in the process. The catalyst appears to interact with the oxidant and/or reductant in such a fashion as to overcome the kinetic barrier. Where the oxidant and reductant are thermodynamically stable in the reaction medium, the catalyst can lower the kinetic barrier by converting either the oxidant or reductant to another form which will provide a thermodynamically unstable combination which is also kinetically unstable. Where the oxidant and reductant are thermodynamically unstable but substantially kinetically stable, the catalyst can function to lower the kinetic barrier, allowing the reaction to proceed at a substantially fast rate.

In one aspect of this invention, an imagewise pattern of catalyst is employed. Any means can be utilized for obtaining the imagewise pattern of catalyst including photoreduction (e.g., the photoreduction of a silver salt such as a silver halide salt to metallic silver, the photoreduction of a palladium salt such as palladium oxalate to metallic palladium, or the photoreduction of a gold salt such as a gold halide salt to metallic gold); photooxidation (e.g., metallic silver to $Ag^+$); the photolytic formation of a suitable inhibitor such as phenylmercaptotetrazole which can be released imagewise from compounds such as those described in Barr et al, U.S. Pat. No. 3,227,554 issued Jan. 4, 1966; electrostatic deposition of a catalyst on a latent image, such as charged particles of carbon or a zero valent metal; the chemical deposition of a catalyst on a latent image, such as the deposition of zero valent metal such as silver or gold, on exposed titanium dioxide or zinc oxide; or mechanical deposition of the catalyst. Various means which can be used to generate catalysts or catalyst precursors include those described and referred to in British Pat. No. 1,194,581 of June 10, 1970, and Hillson and Ridgway, Belgian Pat. No. 750,182 of July 15, 1970.

Some care is needed in selecting the particular oxidant-reductant combination employed in the practice of the invention, bearing in mind the circumstances governing any particular embodiment of the invention. The oxidizing-reducing agent combination should undergo essentially no redox reaction except in the presence of external catalyst material. In the environment in which the reaction takes place, the catalyst should promote the redox reaction, but should not itself undergo a redox reaction directly with either the reducing agent or oxidizing agent to any substantial degree. Preferably, the oxidizing agent and the reducing agent are so chosen that, when test samples thereof are each dissolved at a 0.01 molar concentration in an inert solvent at 20° C., essentially no redox reaction occurs for at least 15 min. and preferably for several hours, such as 12 hr., or several days, such as a month or more.

Combinations of oxidant and reductant which undergo a more rapid redox reaction in the absence of catalyst are, however, useful in embodiments of the invention where the oxidizing agent and reducing agent are in reactive condition for brief periods of time. In one such embodiment, separate solutions of oxidizing agent and reducing agent can be sprayed on a support carrying an imagewise distribution of catalyst. An imagewise redox reaction takes place in the presence of the catalyst. After sufficient redox reaction occurs, the unreacted reducing agent and oxidizing agent are removed in any convenient manner, for example, using an air jet, a stream of liquid or a chemical neutralizer. In other embodiments of the invention, an imagewise pattern of catalyst, together with a nonimagewise distribution of oxidant (or reductant), can be contacted with reductant (or oxidant) for a time sufficient to permit imagewise redox reaction. Thereafter, the reductant (or oxidant) can be removed. In these and other embodiments of the invention, the oxidant and reductant need not possess a high degree of inertness to redox reaction in the absence of catalyst.

In preferred embodiments of the invention, an imagewise pattern of catalyst is contacted with the combination of oxidizing and reducing agent in accordance with the invention. However, a nonimagewise distribution of oxidizing agent and catalyst can be contacted with an imagewise pattern of reducing agent, or an imagewise pattern of oxidizing agent can be contacted with the combination of reducing agent and catalyst to form images in accordance with the invention. Also, an imagewise pattern of catalyst, together with a nonimagewise distribution of oxidizing agent, can be contacted with reducing agent or an imagewise pattern of catalyst, together with a nonimagewise distribution of reducing agent, can be contacted with oxidizing agent to initiate redox reaction in accordance with the invention.

Any suitable means can be utilized to contact the oxidizing agent, reducing agent and catalyst. For example, an imagewise pattern of catalyst can be contacted with a solution containing oxidant and reductant. In one convenient embodiment of the invention, a hydrophilic colloid layer coated on a suitable support contains a pattern of catalyst and is contacted with an aqueous solution containing oxidant and reductant. The concentration of reductant and oxidant in such solutions can vary over a wide range. Optimum concentrations depend on such variables as time of contact, amount of catalyst present, and reactivity of the particular oxidizing agent-reducing agent-catalyst combination chosen. Typical useful concentrations of oxidant and reductant, each, range from about .1 to 50, and preferably 1 to 15, g./liter of solution, using contact or residence times of about from 30 sec. up to 2 hr. or longer. The oxidizing agent and reducing agent can also be contained in and released from rupturable pods or pressure-sensitive capsules. An alternative method for initiating redox reaction in accordance with the invention involves incorporating the oxidant and reductant in a hydrophilic colloid layer coated on a suitable support and contacting the layer with a plate bearing a metal catalyst relief image. The metal relief image initiates and promotes the redox reaction between the oxidant and reductant contained in the hydrophilic colloid layer. If desired, portions of the oxidant or reductant can be incorporated both in processing solutions and hydrophilic colloid layers, which can also contain a suitable source of catalyst such as light-sensitive silver halide.

In those embodiments where the inert transition metal complex is present in the film unit, such as in at least one layer thereof, it is present in a concentration to provide at least 0.1 mg./ft.$^2$ to about 500 mg./ft.$^2$ based on cobalt, and is preferably present in the range of 0.5 mole to 5 moles/mole of silver in said film unit, with generally good results being obtained in amplification processing when a complex such as a cobalt (III) complex is present in at least an equimolar amount based on silver. When the transition metal ion is incorporated in the photographic element, an azaindene compound is generally added to the silver halide emulsion, such as in amounts of above 10 g./mole of silver, as disclosed in Mowrey, U.S. Ser. No. 402,433 filed Oct. 1, 1973.

The reducing agent and the oxidizing agent employed herein advantageously have good solubility in water; preferably, they are soluble in amounts of at least 0.1 g. and preferably at least 10 g./liter of water. However, other solvents, preferably a polar solvent such as methanol or ethanol, can be employed. In certain embodiments of the invention, reducing agents and oxidizing agents having very low water solubility can be employed.

The processes of the invention are admirably suited to amplify faint or even invisible quantities of catalyst. The invention is highly effective with light-sensitive silver halide materials, wherein latent image silver, or a low-density silver image, can be utilized to generate a visible image. In addition, the processes of the invention are useful in supplementing an image, for example, a silver or other zero valent metal image or an image composed of other catalysts, oxidants or reductants utilized in accordance with the invention. It is also possible to replace preformed images with other images in accordance with the processes of the invention.

In one preferred method of forming images in accordance with the invention, at least one of the reaction products of the redox reaction is reacted with a further component or reactive species to produce a change in light value. In a particularly useful embodiment of the invention, the reducing agent forms an oxidized species which reacts, or couples, with certain compounds, known in the art as photographic color couplers, to form image dyes.

In another aspect of the invention, the oxidizing agent, by the redox reaction, is reduced to a species which produces a change in light value by interaction with a reactive species such as an 8-hydroxyquinoline, a formazan dye, a 2,4-diaminophenol, an $\alpha$-nitroso-$\beta$-naphthol or 1-(2′,4′,6′-trichlorophenyl)-3-[3″-(2‴,-4‴-di-tert-amylphenoxyacetamido)benzamido]-5-pyrazolone. Compounds such as 8-hydroxyquinoline are useful in this embodiment of the invention even when the coupling position is blocked. For example, 8-hydroxy-5,7-dimethylquinoline can be employed although both coupling positions are blocked.

In still another aspect of the invention, one of the reaction products of the redox reaction featured in this invention is utilized to decrease the reactivity, or "poison", image-forming components or reactive species.

In certain embodiments of the invention, the products of the redox reaction (i.e., the oxidized reducing agent and the reduced oxidizing agent) are capable of undergoing reaction with a particular reactive species. For certain purposes, it may be desirable to prevent one of the reaction products of the redox reaction from undergoing any substantial reaction with the reactive species. This objective can be readily accomplished by employing a "blocking" reactant which prevents undesired interaction with the reactive species. An example of such a system is a redox combination comprising a cobalt(III) complex oxidizing agent, photographic aromatic primary amino color-developing agent as reducing agent, metallic silver as catalyst, and photographic color coupler as the reactive species. In the presence of the silver catalyst, the cobalt(III) is reduced to cobalt(II) and the developing agent is oxidized. Both the cobalt(II) and the oxidizing developing agent are capable of reacting with many photographic color couplers to produce a change in light value. When the only desired change in light value is the reaction product of the oxidized developing agent and photographic color coupler, the blocking reactant is utilized to prevent interaction between the reduced oxidizing agent (in this instance, cobalt(II) and the photographic color coupler. Any suitable blocking agent can be utilized such as a chelating agent, e.g., ethylenediaminetetraacetic acid, sodium hexametaphosphate, sodium tetraphosphate or 2-hydroxypropylenediaminetetraacetic acid, when it is desired to inhibit the reactivity of the cobalt(II). Other appropriate blocking agents can be selected by the art-skilled for selectively controlling the reactivity of one or more of the reaction products of the redox reaction.

As used herein, the phrase "change in light value" means instances wherein a colored reactive species undergoes a change in color or becomes colorless, as well as instances wherein a colorless reactive species becomes colored.

This invention is particularly useful in processing photographic elements utilized in a subtractive multicolor photographic system wherein the emulsion layers contain, or have contiguous the silver halide thereof, photographic color couplers. As used herein, the term "photographic color coupler" includes any compound which reacts (or couples) with the oxidation products of primary aromatic amino developing agent on photographic development to provide a dye and is nondiffusible in a hydrophilic binder (e.g., gelatin) useful for photographic silver halide. Typical useful color formers include phenolic, 5-pyrazolone and open-chain ketomethylene compounds. Specific cyan, magenta and yellow color formers which can be used, respectively, in the cyan, magenta and yellow dye-forming units of the invention are described in Graham et al, U.S. Pat. No. 3,046,129 issued July 24, 1962, col. 15, line 45, through col. 18, line 51. Such color formers can be dispersed in the emulsion layers in any convenient manner, such as by using the solvents and the techniques described in U.S. Pat. Nos. 2,322,027 or 2,801,171. The useful couplers include Fischer-type incorporated couplers such as those disclosed in Fischer, U.S. Pat. No. 1,055,155, and particularly nondiffusible Fischer-type couplers containing branched carbon chains, e.g., those referred to in the references cited in Frohlich et al, U.S. Pat. No. 2,376,679, col. 2, lines 50–60. These elements can be processed by one of the procedures described in Graham et al, U.S. Pat. No. 3,046,129, col. 23–24, and using an oxidizing agent-reducing agent combination as described herein.

This invention is applicable to photographic processes for forming multicolor transfer images, such as color diffusion transfer processes of the type described in U.S. Pat. Nos. 2,756,142 by Yutzy issued July 24, 1956; 2,983,606 by Rogers issued May 9, 1961; 3,087,817 by Rogers issued Apr. 30, 1963; 3,146,102 by Weyerts issued Aug. 25, 1964; 3,227,550 by Whitmore et al, 3,227,552 by Whitmore, 3,227,551 and 3,227,554, both by Barr et al, all issued Jan. 4, 1966; 3,243,294 by Barr issued Mar. 29, 1966; 3,415,644, 3,415,645 and 3,415,646 by Land, all issued Dec. 10, 1968; 3,443,940 by Bloom et al and 3,443,943 by Rogers, both issued May 13, 1969; and 3,765,886 by Bush et al issued Oct. 16, 1973. The process of this invention is useful in generating diffusible dye images by the method described by Fleckenstein et al, U.S. Ser. No. 176,751 filed Aug. 8, 1971, now abandoned. An oxidant in accordance with the present invention, such as a cobalt complex, e.g., cobalt hexammine(III) chloride, is present during development. The developer (which can be a black-and-white developing agent or a color-developing agent) undergoes a redox reaction with the oxidant, and the resulting oxidized form of the reducing agent cross-oxidizes with a nondiffusible compound (e.g., a p-sulfonamidoaniline or a p-sulfonamidophenol) which, upon oxidation, releases a diffusible color-providing moiety.

The processes of this invention are useful in color diffusion transfer systems, such as those wherein the dye-receiving sheet is separated from the photosensitive element after processing, such as the elements described in U.S. Pat. No. 3,362,819, and color diffusion transfer systems wherein the film unit and the dye image-receiving layer are integral, as described in U.S. Ser. Nos. 115,459 by Barr et al and 115,552 by Cole, both filed Feb. 16, 1971, and now abandoned. The present invention allows the use of thinner layers in the photosensitive elements, thus requiring a smaller amount of processing composition. The processing composition accordingly can contain less solvent, which reduces problems associated with evaporating solvent after processing the photographic elements. When opacifying agents are employed, it is preferable that they be chosen so that they are not catalysts for a redox reaction as described herein, if such reaction would tend to degrade the quality of the image.

This invention is useful in developing any of the exposed light-sensitive silver halides including silver bromide, silver chloride, or mixed silver halides such as silver chlorobromide, silver bromoiodide or silver chlorobromoiodide. The invention is useful in developing negative emulsions, as well as emulsions in which the silver halide grains have high internal sensitivity, or fogged direct-positive emulsions, such as those described in U.S. Pat. Nos. 2,497,875 by Falleson issued Feb. 21, 1950; 2,563,785 by Ives issued Aug. 7, 1951; 3,501,305, 3,501,306 and 3,501,307, all by Illingsworth and issued Mar. 17, 1970; 3,687,676; 3,690,891; 3,761,267 by Solomon et al; and 3,761,276 by Evans; and U.S. Ser. No. 56,702 by Gilman et al filed July 20, 1970. Other light-sensitive materials which form catalysts can also be utilized. A particularly useful class of light-sensitive catalyst-producing materials is the class of silver spectral-sensitizing dye complexes described in Gilman et al, U.S. Pat. No. 3,446,619 issued May 27, 1969. The most useful species of such light-sensitive materials are the reaction prodduct of silver ion with a cyanine, merocyanine, oxonol, hemioxonol, hemicyanine, styryl or benzylidene dye.

The color diffusion transfer processes of this invention generally involve the use of a photographic element comprising a support, at least one silver halide emulsion, and an image dye-providing material which is contained in or contiguous said layer. After exposure, such a photographic element is treated with an alkaline processing solution to effect imagewise discrimination in the element. As is well-known in the art, the dye-providing material can be initially immobile or initially mobile in the processing solution. Upon alkaline processing of an initially immobile dye-providing material, a mobile dye or dye precursor can be released imagewise or the material can be imagewise rendered mobile. If the material is initially mobile, the processing solution typically renders the material insoluble (and thus immobile) in an imagewise fashion. Whether initially mobile or immobile, upon treatment with a processing solution the dye-providing material typically is oxidized under alkaline conditions, thereby producing imagewise discrimination in the element.

Exemplary color diffusion transfer processes are those using developing agents as disclosed in U.S. Pat. Nos. 2,698,798 and 2,559,643 wherein a latent silver halide image is developed with a color-developing agent. As development proceeds, the color-developing agent reduces the exposed silver halide to metallic silver and the color-developing agent which is oxidized as a function of development forms an immobile species while the unoxidized color-developing agent is free to migrate to a receiving element. After migration, the color-developing agent in the receiver is oxidized. The oxidized developing agent then self-couples or couples with a color coupler to form a positive dye image.

In certain preferred embodiments of this invention, the film units contain an image dye-providing material which can be described by the formula:

Q-(Imagant)

wherein Imagant is an image dye or image dye precursor, and Q is a monitoring group which can be (1) a silver halide developing agent which is preferably an aromatic group such as a carbocyclic or benzenoid group which is polysubstituted with hydroxy, amino or substituted amino groups thereon, or (2) an oxidizable releasing group (i.e., a group which can be oxidized to facilitate subsequent release of said Imagant) or a group which can be oxidized to prevent the normal release of said Imagant under processing conditions. When Q is a silver halide developing agent, the resultant compound is preferably initially mobile, and when Q is an oxidizable releasing group, the resultant compound is preferably initially immobile.

Initially mobile image dye-providing materials within the above formula which can be used in the film units of this invention include dye developers as disclosed in U.S. Pat. Nos. 2,893,606, 3,146,102, 3,161,506, 3,218,164, 3,307,947, 3,544,545 and the like. In certain embodiments, the initially mobile image dye-providing materials are oxichromic developers as described in Lestina and Bush, U.S. Ser. No. 308,869 filed Nov. 22, 1972, which is incorporated herein by reference, and includes those compounds which undergo chromogenic oxidation to form a photographic image dye. The image dye-providing material can also comprise a shifted dye as disclosed in Bush and Reardon, U.S. Ser. No. 227,113 filed Feb. 17, 1972.

In another embodiment, the image dye-providing material within the above formula is an initially immobile compound which can include compounds as disclosed in Canadian Pat. No. 602,607 by Whitmore et al issued Aug. 2, 1960, U.S. Ser. Nos. 351,673 by Fleckenstein et al and 351,700 by Fleckenstein, both filed Apr. 16, 1973, and U.S. Pat. Nos. 3,227,552 by Whitmore, 3,443,939, 3,443,940, 3,443,941, 3,698,897 by Gompf et al, 3,725,062 by Anderson et al, and 3,728,113 by Becker et al, and the like, all of which are incorporated herein by reference. In one preferred embodiment, the initially immobile image dye-providing material is a positive-working, immobile photographic compound as disclosed in Hinshaw and Condit, U.S. Ser. No. 326,628 filed Jan. 26, 1973, which is incorporated herein by reference.

The image dye-providing materials are generally located within a color-providing layer unit, along with a silver halide emulsion to provide the respective colors needed for a multicolor image. It is understood that the layer unit can also contain a silver halide emulsion layer having an adjacent layer containing physical-development nuclei associated with the image dye-providing material. Typical photographic elements of this type are disclosed in U.S. Pat. No. 3,227,551 (col. 6–7) and British Pat. No. 904,364 (p. 19), which are incorporated herein by reference.

A suitable image-transfer film unit in which the present inert transition metal complexes are useful typically comprises:

1. a photosensitive element comprising a support having thereon at least one layer containing a silver halide emulsion having associated therewith an image dye-providing material and preferably at least three of said layers wherein one layer contains a blue-sensitive silver halide emulsion, one layer contains a green-sensitive silver halide emulsion, and one layer contains a red-sensitive silver halide emulsion;
2. an image-receiving layer which can be located on a separate support superposed or adapted to be superposed on said photosensitive element or, preferably, which can be positioned in the photosensitive element on the same support adjacent the photosensitive silver halide emulsion layers; and
3. means containing an alkaline processing composition adapted to discharge its contents within said film unit.

Where the receiver layer is coated on the same support with the photosensitive silver halide layers, the support is preferably a transparent support, an opaque layer is preferably positioned between the image-receiving layer and the photosensitive silver halide layer, and the alkaline processing composition preferably contains an opacifying substance such as carbon or pH-indicator dye which is discharged into the film unit between a dimensionally stable support or cover sheet and the photosensitive element. In certain embodiments, the cover sheet can be superposed or adapted to be superposed on the photosensitive element. The image-receiving layer can be coated on the cover sheet. In certain preferred embodiments where the image-receiving layer is located in the photosensitive element, a neutralizing layer is located on the cover sheet.

The means for containing the alkaline processing solution can be any means known in the art for this purpose, including rupturable containers positioned at the point of desired discharge of its contents into the film unit and adapted to be passed between a pair of juxtaposed rollers to effect discharge of the contents into the film unit, frangible containers positioned over or within the photosensitive element, hypodermic syringes, and the like.

The silver halide emulsions useful in my invention are well-known to those skilled in the art and are described in *Product Licensing Index*, Vol. 92, December, 1971, publication 9232, p. 107, par. I, "Emulsion types"; they may be chemically and spectrally sensitized as described on p. 107, par. III, "Chemical sensitization", and pp. 108–109, par. XV, "Spectral sensitization", of the above article; they can be protected against the production of fog and can be stabilized against loss of sensitivity during keeping by employing the materials described on p. 107, par. V, "Antifoggants and stabilizers", of the above article; they can contain development modifiers, hardeners and coating aids as described on pp, 107–108, par. IV, "Development modifiers", par. VII, "Hardeners", and par. XII, "Coating aids", of the above article; they and other layers in the photographic elements used in this invention can contain plasticizers, vehicles and filter dyes described on p. 108, par. XI, "Plasticizers and lubricants", and par. VIII, "Vehicles", and p. 109, par. XVI, "Absorbing and filter dyes", of the above article; they and other layers in the photographic elements used in this invention may contain addenda which are incorporated by using the procedures described on p. 109, par. XVII, "Methods of addition", of the above article; and they can be coated by using the various techniques described on p. 109, par. XVIII, "Coating procedures", of the above article; the disclosures of all of which are hereby incorporated by reference.

Any material can be employed as the image-receiving layer in this invention as long as the desired function of mordanting or otherwise fixing the dye images will be obtained. The particular material chosen will, of course, depend upon the dye to be mordanted. If acid dyes are to be mordanted, the image-receiving layer can contain basic polymeric mordants such as polymers of amino guanidine derivatives of vinyl methyl ketone such as described in Minsk, U.S. Pat. No. 2,882,156 issued Apr. 14, 1959, and basic polymeric mordants such as described in Cohen et al, U.S. Pat. No. 3,709,690 issued Jan. 9, 1973.

Additional mordants include cationic mordants such as polymeric compounds composed of a polymer having quaternary nitrogen groups and at least two aromatic nuclei for each quaternary nitrogen in the polymer cation (i.e., having at least two aromatic nuclei for each positively charged nitrogen atom), such polymeric compounds being substantially free from carboxy groups. Useful mordants of this type are comprised of units of the following formula in copolymerized relationship with units of at least one other ethylenically unsaturated monomer:

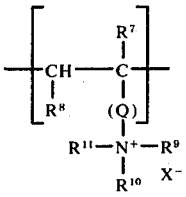

wherein each of $R^7$ and $R^8$ represents a hydrogen atom or a lower alkyl radical (of 1 to about 6 carbon atoms), and $R^8$ can additionally be a group containing at least one aromatic nucleus (e.g., phenyl, naphthyl, tolyl; Q can be a divalent alkylene radical (of 1 to about 6 carbon atoms), a divalent arylene radical, a divalent aralkylene radical, a divalent alkarylene radical,

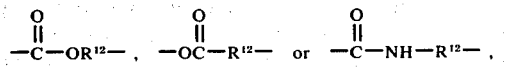

wherein $R^{12}$ is an alkylene radical; or $R^8$ can be taken together with Q to form a

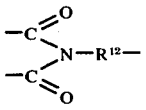

group; $R^9$, $R^{10}$ and $R^{11}$ can be lower alkyl or aryl, or $R^9$ and $R^{10}$ and the nitrogen atom to which they are attached can together with Q represent the atoms and bonds necessary to form a quaternized nitrogen-containing heterocyclic ring; and $X^-$ is a mono-valent negative salt-forming radical or atom in ionic relationship with the positive salt-forming radical; wherein said polymer is substantially free from carboxy groups and wherein the positive salt-forming radical of said polymer comprises at least two aryl groups for each quaternary nitrogen atom in said polymer. These preferred polymeric cationic mordants are described further in the above-mentioned U.S. Pat. No. 3,709,690.

Other mordants useful in my invention include poly-4-vinylpyridine, the 2-vinylpyridine polymer metho-p-toluenesulfonate and similar compounds described in Sprague et al, U.S. Pat. No. 2,484,430 issued Oct. 11, 1949, and cetyl trimethylammonium bromide, etc. Effective mordanting compositions are also described in U.S. Pat. Nos. 3,271,148 by Whitmore and 3,271,147 by Bush, both issued Sept. 6, 1966.

The term "image dye-providing material" as used herein is understood to refer to those compounds which either (1) do not require a chemical reaction to form the image dye or (2) undergo reactions encountered in photographic imaging systems to produce an image dye, such as with color couplers, oxichromic compounds and the like. The first class of compounds is generally referred to as preformed image dyes and includes shifted dyes, etc., while the second class of compounds is generally referred to as dye precursors.

The image-transfer film units of this invention, as defined above contain a photographic element which comprises a support having thereon image dye-providing layer units. A multicolor photographic element comprises at least two of said image dye-providing layer units, each of which records light primarily in different regions of the light spectrum. The layer unit comprises a light-sensitive silver salt, which is generally spectrally sensitized to a specific region of the light spectrum, and has associated therewith a photographic color coupler. In certain preferred embodiments, the image dye-providing layer units are continuous layers which are effectively isolated from other layer units by barrier layers, spacer layers, layers containing scavengers for oxidized developer and the like to prevent any substantial color contamination between the image dye-providing layer units. In other embodiments, the layer units are discontinuous layers comprising mixed packets which are effectively isolated from each other, as disclosed in Godowsky, U.S. Pat. No. 2,698,794 issued Jan. 4, 1954. The effective isolation of the layer units is known in the art and is utilized to prevent interimage contamination during the initial stages of processing in many commercial color products.

In certain preferred embodiments, the photographic elements used in the film units of this invention comprise a support having thereon at least one image dye-providing layer unit containing a light-sensitive silver salt, preferably silver halide, having associated therewith a stoichiometric excess of image dye-providing material, such as a coupler, of at least 40% and at least preferably 70%. The equivalency of the image dye-providing material, for example, color couplers, is known in the art. A 4-equivalent coupler requires 4 moles of oxidized color developer, which in turn requires development of 4 moles of silver, to produce 1 mole of dye. Thus, for a stoichiometric reaction with silver halide, 1-equivalent weight of this coupler will be 0.25 mole. In accordance with preferred embodiments of this invention, the color image-providing unit comprises at least a 40% excess of the equivalent weight of image dye-providing material required to react on a stoichiometric basis with the developable silver and preferably a 70% excess of said material. In one highly preferred embodiment, at least a 110% excess of said material is present in said dye image-providing layers based on silver. Preferably, the coupler-to-silver ratio is based on effective silver as defined herein. The ratio can also be defined as an equivalent excess with a coupler-to-silver ratio of at least 1.4:1, and preferably at least 1.7:1 (i.e., 2:1 being a 100% excess). With other image dye-providing materials, the equations can be determined in the same way, i.e., by determining how many moles of silver are required to produce 1 mole of mobilized or immobilized dye. Weight ratios of coupler-to-silver coverage which are particularly useful are from 4 to 15 parts by weight coupler to 1 part by weight silver. Advantageously, the image dye-providing material is present in an amount sufficient to give a density of at least 1.7 and preferably at least 2.0. Preferably, the difference between the maximum density and the minimum density (which can comprise unbleached silver) is at least .6 and preferably at least 1.0.

It is realized that the density of the dye may vary with the image dye-providing material used, and accordingly the quantity of the material can be adjusted to provide the desired density. Preferably, each layer unit contains at least $1 \times 10^{-5}$ moles/ft.$^2$ of the image dye-providing material.

Advantageously, the photographic image dye-providing materials utilized are selected so that they will give a good neutral dye image. Preferably, the cyan dye has its major visible light absorption between about 600 and 700 nm., the magenta dye has its major absorption between about 500 and 600 nm., and the yellow dye has its major absorption between about 400 and 500 nm.

Generally, each of the image dye-providing layer units of the photographic elements contains a light-sensitive silver salt which is preferably a silver halide. In one preferred embodiment, each of at least two of the image dye-providing layer units comprises a silver salt at a concentration of up to 30 mg. of silver/ft.$^2$. However, while the developable silver halide is preferably present at concentrations based on silver of less than 30 mg./ft.$^2$, it is possible to coat blended emulsions at higher coverages within this embodiment, as long as no more than 30 mg./ft.$^2$ of silver develops; for example, such emulsions may contain silver halide grains which are relatively light-insensitive or may contain development restrainers, such as with development inhibitor-releasing couplers, and still provide a photographic element which is advantageously used in the various processes as described herein to produce improved image records. In some instances, emulsions containing relatively light-insensitive grains or development inhibitors are desirable to enable one to obtain more uniform coating coverage with less precise coating equipment, as well as for other reasons. Thus, highly preferred photographic elements of this invention contain at least two color-providing layer units, each containing a silver halide emulsion, defined in terms of "effective coverage" and developability, as one which, when it is fully exposed and processed for about 1 min. at 100° F. in the following developer:

| | | |
|---|---|---|
| benzyl alcohol | 10 | ml. |
| $K_2SO_3$ | 2 | g. |
| KBr | 0.4 | g. |
| hydroxylamine sulfate | 2 | g. |
| 4-amino-N-ethyl-N-(2-methoxyethyl)-m-toluidine di-paratoluenesulfonate | 5 | g. |
| $K_2CO_3$ | 30 | g. |
| Na4EDTA | 5 | g. |
| water to 1 liter | | |
| pH 10.1 at 24° C. | | |

will provide less than 30 mg. of metallic silver/ft.$^2$ and preferably less than 15 mg./ft.$^2$. It is understood that the term "effective silver" refers to that amount of silver which is developed in this test and that ratios of coupler to silver are based on "effective silver" which is produced by this type of development when so specified herein. In most instances, the quantity of effective silver as silver halide in the undeveloped, unexposed photographic element will be quite similar to quantity of total silver present as silver halide. The fully exposed layer containing silver halide emulsion is one which is exposed to Dmax as is well-known in the art, for example, by exposure to a 500-watt, 3000° K lamp for about 10 sec. (total exposure at the film plane = $11.3 \times 10^4$ ergs./cm.$^2$).

The invention can be further illustrated by the following examples.

EXAMPLE 1

A photosensitive element is prepared having the following structure (concentrations are given in mg./ft.$^2$):

Layer 3 a. gelatin, 300 mg.;

b. silver bromoiodide (6 mole percent of the halide being iodide), coated at a silver coverage of 100 mg.;

c. 100 mg. of the following development inhibitor-releasing coupler:

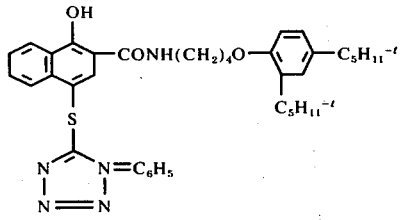

dissolved in about 100 mg. coupler solvent, such as dibutyl phthalate.

Layer 2 a. 50 mg. of the ballasted oxidized color-developing agent scavenger coupler:

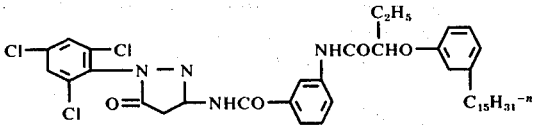

dissolved in 50 mg. of a coupler solvent, such as dibutyl phthalate;

b. gelatin, 200 mg.

Layer 1 a. palladium nuclei, .5 mg.;

b. 90 mg. of the colorless image-transfer coupler:

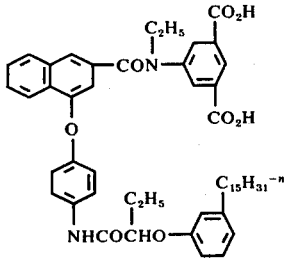

dissolved in 90 mg. dibutyl phthalate;

c. gelatin, 300 mg.

Support: Cellulose Triacetate

The above element is sensitometrically exposed through a graduated-density test object; soaked in a processing solution (composition given below), containing an oxidizing agent-reducing agent combination in accordance with this invention, for 10 sec.; and brought into contact for 2 min. with a mordant receiver, such as a paper having a gelatin layer containing a mordant such as cetyl trimethyl ammonium bromide, which has been soaked in the processing composition for 1 min. Upon separation of the receiving sheet and the photosensitive element, a positive dye image (maximum density, .90) of the test object is contained in this receiving sheet.

| Processing Solution | | |
|---|---|---|
| $Na_2SO_3$ | 50 | g. |
| NaOH | 5 | g. |
| 1-phenol-3-pyrazolidone | 0.1 | g. |

-continued

| Processing Solution | | |
|---|---|---|
| 4-amino-N-ethyl-N-β-hydroxyethylaniline sulfate (color-developing agent) | 10.0 | g. |
| $[Co(NH_3)_6]Cl_3$ (oxidant) | 2.5 | g. |
| water to 1 liter | | |

EXAMPLE 2

Example 1 is repeated except that the palladium nuclei in Layer 1 is replaced with silver nuclei (at 0.5 mg./ft.$^2$) and the exposed element is contacted with the processing solution for 30 sec. Upon separation of the receiving sheet and the photosensitive element, a positive dye image is obtained which has a maximum density of 0.81.

EXAMPLE 3-A

A photosensitive element is prepared as in Example 1, except that Layer 1 contains 10 mg. silver nuclei/ft.$^2$ and the colorless image-transfer coupler is replaced with 90 mg. of the colored image-transfer coupler:

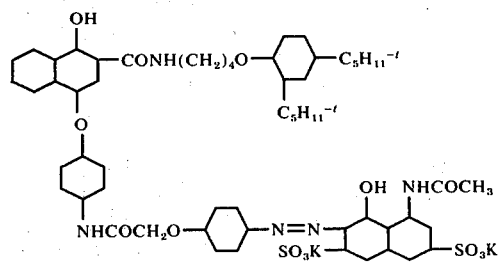

A positive dye image is obtained on the receiving sheet, after 5 min. contact time with the photosensitive element, which has a maximum density of 0.66.

Example 3-B shows the decreased density obtained when an oxidant is not employed in accordance with the invention during the development and processing of elements used in dye-transfer processes.

EXAMPLE 3-B

Example 3-A is repeated except that the oxidant, cobalt hexammine (III) chloride, is omitted from the processing solution, which is further modified to contain 25 g./liter NaOH and 1.5 g./liter of the silver solvent bis(methylsulfonyl)methane. The maximum density of the transferred dye image is only 0.50.

EXAMPLE 4

A photosensitive element is prepared as in Example 1 except that 50 mg./ft.$^2$ of cobalt hexammine(III) chloride is incorporated in Layer 1. Processing is conducted with a solution having the same composition as the one given in Example 1 except that the cobalt complex is omitted. A positive dye transfer image is obtained having a maximum density of 1.08.

EXAMPLE 5

Example 1 is repeated except that a silver halide solvent, e.g., bis(methylsulfonyl)methane, is incorporated in the processing solution at 0.15 g./liter. The maximum density of the positive transferred dye image is 1.10. However, when this example is repeated with the oxidant cobalt hexammine(III) chloride omitted from the processing solution, the maximum density of the positive transferred dye image is only 0.48. Results similar to those obtained above are achieved when the cobalt hexammine chloride is replaced with other oxidants such as $[Co(en)_2dien]Cl_2.HCl$, $[Co(NH_3)_4(H_2O)_2](ClO_3)$, $[Co(NH_3)_5H_2O](ClO_4)_3$, trans-$NH_4[Co(NH_3)_2(NO_2)_4]$, $[Co(NO_2)_3(NH_3)_3]$, $[Co(NH_3)_4CO_3]NO_3$, $[Co(NH_3)_5CO_3]NO_3$, trans-$[Co(en)_2Cl_2]Cl.HCl$, trans-$[Co(en)_2(N_3)(NO_2)]S_2O_6$, $[Co(en)_2(NO_3)_2]NO_3$, $[Co(dien)(SCN)_2(OH)][Co(trien)(NO_2)_2]NO_3.H_2O$, cis-$[Co(trien)Cl_2]Cl$, $[Co(en)_2(NO_2)_2](ClO_4)_3$, $[Co(trien)(N_3)_2]NO_3$ and $[Co(en)_2(NH_3)_2]Cl_3$.

Multicolor positive dye transfer images of good density are obtained when oxidants of the type described herein are incorporated in the processing solution or the photosensitive element (preferably in the layer of the light-sensitive element containing the image-transfer coupler), such as the multicolor photosensitive elements described in Barr et al, U.S. Pat. No. 3,227,551 issued Jan. 4, 1966, or the element described in British Pat. No. 904,364, p. 19, lines 1–40. Also, good results are obtained when the oxidant is incorporated in the processing solution or the multicolor photosensitive element (preferably the fogged direct-positive emulsion layer) described in Whitmore et al, U.S. Pat. No. 3,227,550 issued Jan. 4, 1966.

EXAMPLE 6

A photographic element is prepared by coating on a support a layer containing a silver bromide emulsion (0.4 $\mu$ mean grain size) at 108 mg. Ag/ft.$^2$, gelatin at 400 mg./ft.$^2$, and 110 mg./ft.$^2$ of 1-hydroxy-4-{4′-[$\alpha$-(3″-pentadecylphenoxy)butyramido]phenoxy}-N-ethyl-(2‴,5‴-dicarboxy)-2-naphthanilide:

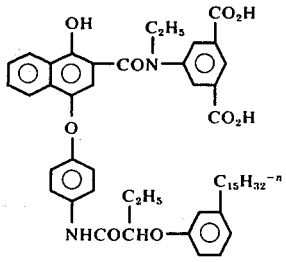

The element is exposed to a graduated-density test object and then processed in the following sequence:

1. black-and-white development, 5 min. (Kodak DK-50);
2. fix for 5 min.;
3. wash for 5 min.;
4. dry.

The sample now contains a black silver image in proportion to the initial exposure. Undeveloped silver halide has been removed by the fix and wash cycles.

The sample is pressed into contact for 2 min. with a receiver consisting of a supported gelatin layer containing the mordant copoly[styrene-(N,N-dimethyl-N-benzyl-N-3-maleimidopropyl)ammonium] chloride after the application between the sample and the receiver of a viscous processing fluid consisting of 20 g. $Na_2CO_3$; 20 g. hydroxyethyl cellulose; 18 g. 4-amino-N-ethyl-N-(2-methoxyethyl)-m-toluidine, di-p-toluenesulfonate, color-developing agent; and 4 g. cobalt hexammine chloride, $[Co(NH_3)_6]Cl_3$, dissolved in 1 liter of water and having a pH of 11.0.

Upon separation of the sample from the receiver, the latter contains a transferred cyan dye image whose maximum (Dmax) and minimum (Dmin) densities to red light are 0.72 and 0.06, respectively.

When the above-described procedure is repeated with a processing fluid which does not contain the cobalt hexammine, no dye image is produced in the receiver.

EXAMPLE 7

A photographic element is prepared by coating on a support a layer containing gelatin at 300 mg./ft.$^2$, a 0.8 $\mu$ silver bromide emulsion at 86 mg. Ag/ft.$^2$, and 80 mg./ft.$^2$ of Redox Releaser I dissolved in diethyl lauramide at 80 mg./ft.$^2$. Redox Releaser I is as follows:

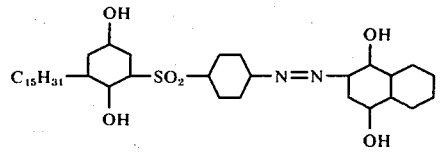

The elements are exposed to a graduated-density test object and processed as described in Example 7.

The sample is pressed into contact for 5 min. with a receiver consisting of a supported gelatin layer containing the mordant copoly[styrene-(N,N-dimethyl-N-benzyl-N-3-maleimidopropyl)ammonium] chloride after application between the sample and the receiver of a viscous processing solution containing 1 g./liter of $[Co(NH_3)_6]Cl_3$, 0.75 g./liter of N-methyl-p-aminophenol, and 25 g./liter of $Na_2SO_3$ at 0.114 KOH.

When the receiver sheet is separated from the photographic element, a negative image in dye is present on the receiver.

A control strip treated by the above sequence with no cobalt complex in the viscous processing solution exhibits essentially no image.

EXAMPLE 8

An image-transfer photographic element containing the dye developers shown in columns 6 and 7 of U.S. Pat. No. 3,362,819 is exposed through a graduated-density test object, developed for 90 sec. at 70° F. in Kodak D-19 developer, fixed and washed.

A first sample is then brought into contact with a receiver of the type mentioned in Example 1 of U.S. Pat. No. 3,362,819 in the presence of a processing composition as mentioned in the same Example 1 of U.S. Pat. No. 3,362,819. Upon separation of the sample from the receiver, the latter contains dye in a nonimagewise pattern. This result indicates that the oxidized developing agent from the D-19 black-and-white developing solution has not crossoxidized with the dye developers in areas of development.

A second sample is exposed, developed, fixed and washed as described next above, then treated for 3 min. at 70° F. in a 1-liter aqueous solution containing 1.6 g. of $[Co(NH_3)_6]Cl_3$ (pH 10.0), washed for 5 min., and then contacted with a receiver as described above. Again, dye has transferred in a nonimagewise pattern, indicating that the introduced cobalt has not oxidized the dye developer.

A third sample is exposed, developed, fixed and washed as described above, then treated for 10 min. at 70° F. in the following solution:

| | | |
|---|---|---|
| water | 800 | ml. |
| $[Co(NH_3)_6]Cl_3$ | 1.6 | g. |
| 4-amino-N-ethyl-N-(2-methoxyethyl)-m-toluidine, di-p-toluenesulfonate | 3 | g. |
| N,N,N',N'-tetramethyl-p-phenylenediamine | 0.5 | g. |
| $K_2CO_3$ | 10 | g. |
| $K_2SO_3$ | 2 | g. |
| water to 1 liter; pH 10.0 | | |

The sample is washed for 5 min. and then contacted with a receiver under the conditions described above. A positive three-color reproduction of the photograhed test object is obtained.

It is apparent that the image silver predeveloped during the first developing cycle serves as a catalyst in the redox-couple reaction between the cobalt hexammine and developing agent, and that one or both of these then crossoxidize the dye developer and immobilize it in proportion to the exposure of the silver halide.

EXAMPLE 9

A photographic element is prepared by coating a support with a layer containing 300 mg./ft.$^2$ of gelatin, 86 mg./ft.$^2$ of a silver bromide emulsion based on silver, and 50 mg./ft.$^2$ of Redox Releaser II dissolved in diethyl lauramide at 50 mg./ft.$^2$. Redox Releaser II is as follows:

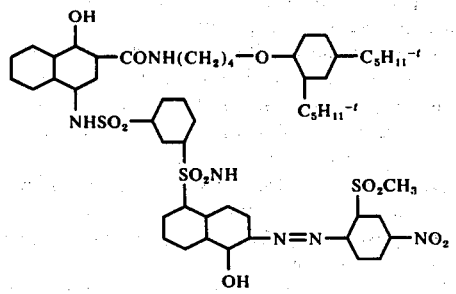

The element is exposed to a graduated-density test object, developed for 1 min. at 68° F. in Kodak DK-50, fixed for 5 min. in Kodak F-5 fix, washed and dried.

The sample now contains a negative black-and-white silver image reproduction of the photograhic test object.

a. Upon imbibition for 8 min. with a pH 10, carbonate buffer solution containing 0.75 g. of 4-hydroxymethyl-4-methyl-1-phenyl-3-pyrazolidone/liter of solution, a first strip of the sample is contacted for 1 min. with a mordanted receiver in the presence of a viscous 2% NaOH processing composition. Upon separation of the sample from the receiver, the latter contains a faint dye image.

b. A repetition of the above-described procedure with a second strip of the same coating sample and another portion of the same buffer solution, which now contains in addition 1 g. of $[Co(NH_3)_6]Cl_3$/-liter of solution, produces a transferred cyan dye image.

EXAMPLE 10

A photographic element is prepared as follows:

a. support;

b. layer containing 125 mg./ft.$^2$ of gelatin and 6.5 × $10^{-5}$ mole/ft.$^2$ of Oxichromic Compound I dissolved in diethyl lauramide at a 1:1.5 weight ratio;

c. layer containing a silver bromide emulsion at 100 mg. Ag/ft.$^2$, 100 mg./ft.$^2$ of gelatin, and 10 mg./ft.$^2$ of 1-phenyl-3-pyrazolidone;

d. layer containing 85 mg./ft.$^2$ of gelatin.

Oxichromic Compound I is as follows:

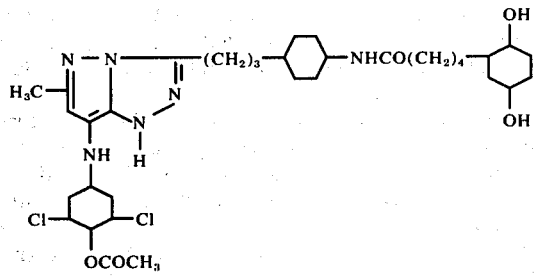

Strips are exposed to a graduated-density test object, black-and-white developed for 1 min. at a temperature of 68° F. in Kodak DK-50, fixed for 5 min. in Kodak F-5 fixing solution, washed for 10 min. and dried. The pH in this process is maintained at 9.5 or below, whereby substantially all of the oxichromic compound is retained in said element since it is relatively insoluble at this pH.

The sample now contains a negative black-and-white silver image reproduction of the photographic test object.

a. Upon imbibition for 8 min. with a pH 10, carbonate buffer solution containing 0.75 g. of 4-hydroxymethyl-4-methyl-1-phenyl-3-pyrazolidone/liter of solution, a first strip of the sample is contacted for 1 min. with a mordanted receiver in the presence of a viscous 2% NaOH processing composition. Upon separation of the sample from the receiver, the latter contains a faint dye image.

b. A repetition of the above-described procedure with a second strip of the same coating sample and another portion of the same buffer solution, which now contains in addition 1 g. of $]Co(NH_3)_6]Cl_3$/-liter of solution, produces a transferred magenta dye image.

In the present strips, unoxidized (i.e., not immobilized) oxichromic compound is monitored by its transfer to the mordanted receiver which, in turn, oxidizes in the presence of air to form a dye. Only faint image discrimination is observed in the control samples, but an imagewise pattern of magenta dye is observed in the sample as processed in the cobalt complex.

Although the invention has been described in considerable detail with particular reference to certain preferred embodiments thereof, variations and modifications can be effected within the spirit and scope of the invention.

I claim:

1. In a photographic image-transfer film unit comprising (1) a support having thereon at least one layer containing a silver halide emulsion having associated therewith an image dye-providing material, (2) an image dye-receiving layer containing an image dye mordant and (3) means for discharging an alkaline processing solution within said film unit, the improvement wherein said film unit comprises (a) a silver halide developing agent and (b) a positively charged inert transition metal ion complex oxidizing agent capable of having at least two valence states and having a coordination number of 6, which undergo redox reaction in the presence of metallic silver, and which are substantially inert to said redox reaction in the absence of a metal or chalcogen catalyst.

2. A photographic film unit as described in claim 1 wherein said image dye-providing material is an immobile compound capable of providing an imagewise distribution of dye as a function of reaction with the oxidation product of said silver halide developing agent and said transition metal ion complex is a water-soluble metal ion complex.

3. A photograhic film unit as described in claim 2 wherein said image dye-providing compound contains a preformed dye which can be released from said compound as a function of oxidation thereof to provide a diffusible image dye.

4. A photographic film unit as described in claim 2 which contains at least three separate layers which contain a silver halide emulsion, each having associated therewith an image dye-providing material.

5. A photographic film unit as described in claim 1 wherein said image dye-providing material is an initially mobile material which is capable of providing an imagewise distribution of said initially mobile material as a function of oxidation thereof or reaction with the oxidized form of said silver halide developing agent.

6. A photographic film unit as described in claim 5 wherein said image dye-providing material contains a preformed dye.

7. A photographic film unit as described in claim 5 wherein said image dye-providing material comprises an image dye precursor.

8. A photographic element as described in claim 5 wherein said image dye-providing material is a color coupler.

9. A photographic element as described in claim 1 wherein said transition metal ion complex is a cobalt-(III) ion complex having a coordination number of 6.

10. A photographic element as described in claim 1 wherein said silver halide emulsion has associated therewith at least a 40 percent stoichiometric excess of said image dye-providing material based on silver in said layer.

11. A photographic image-transfer film unit comprising (1) a support having thereon at least two separate image dye-providing layer units, each of which contains a photographic silver halide having associated therewith an image dye-providing material in at least a 40 percent stoichiometric excess based on silver, (2) an image-receiving layer containing an image dye mordant, (3) a liquid processing composition adapted to be discharged within said film unit, and (4) a silver halide developing agent and a positively charged insert transition metal ion complex oxidizing agent capable of having at least two valence states and having a coordination number of 6, which undergo redox reaction in the presence of metallic silver and wherein said reducing agent and said oxidizing agent exhibit substantially no redox reaction when dissolved at a .01 molar concentration in an inert solvent at 20° C.

12. A film unit as described in claim 11 wherein said silver halide is present in each of said layer units in a concentration of less than 30 mg./ft.$^2$.

13. A film unit as described in claim 11 which comprises at least three image dye-providing layer units which contain said silver halide emulsion at a coverage of less than 30 mg./ft.$^2$ and which layer units contain a magenta image dye-providing material, a cyan image dye-providing material and a yellow image dye-providing material, respectively.

14. A film unit as described in claim 11 wherein said transition metal ion complex is present in at least an equimolar concentration based on the silver content of two of said layer units.

15. A film unit as described in claim 11 wherein said silver halide developing agent is a pyrazolidone compound.

16. A film unit as described in claim 11 wherein said inert transition metal ion complex is present in said film unit in a concentration to provide at least 0.1 mg./ft.$^2$ based on said metal.

17. A film unit according to claim 16 wherein said inert transition metal ion complex is a cobalt(III) ion complex.

18. A film unit according to claim 11 wherein said silver halide is present in each of said layer units in a concentration of less than 30 mg./ft.$^2$, and said inert transition metal ion complex is a cobalt(III) ion complex.

19. A film unit according to claim 18 wherein said image dye-providng material is a compound of the formula:

Q-(Imagant)

wherein Imagant is an image dye or image dye precursor, and Q is (a) a silver halide developing agent or (b) an oxidizable releasing group.

20. A photographic film unit comprising:

a. a photosensitive element comprising a support having thereon at least one photosensitive silver halide emulsion layer, each said layer having associated therewith a nondiffusible dye image-providing material capable of reacting with oxidized developing agent to produce a diffusible dye;

b. a support having thereon an image-receiving layer; and c. a rupturable container containing an alkaline processing composition;

said film unit containing an aromatic primary amino color-developing agent and a positively charged inert transition metal ion complex oxidizing agent capable of having at least two valence states and having a coordination number of 6, which undergoes imagewise redox reaction with said developing agent in areas where metallic silver develops and which is substantially inert in areas where there is no metallic silver.

21. The photographic film unit of claim 20 wherein the photosensitive portion of said photosensitive element comprises a red-sensitive silver halide emulsion layer having associated therewith a cyan image dye-providing material comprising a nondiffusible coupler capable of reacting with oxidized aromatic primary amino color-developing agent to produce a diffusible cyan dye, a green-sensitive silver halide emulsion layer having associated therewith a magenta image dye-providing material comprising a nondiffusible coupler capable of reacting with oxidized aromatic primary amino color-developing agent to produce a diffusible magenta dye, and a blue-sensitive silver halide emulsion layer having associated therewith a yellow image dye-providing material comprising a nondiffusible coupler capable of reacting with oxidized aromatic primary amino color-developing agent to produce a diffusible yellow dye, and said transition metal ion complex is a cobalt ion complex having a coordination number of 6.

22. The photographic film unit of claim 21 wherein said cobalt complex is cobalt hexammine(III) chloride.

23. A process of forming a transfer image comprising:

a. imagewise-exposing a photosensitive element comprising a support having thereon at least one photosensitive silver halide emulsion layer, each said layer having associated therewith an image dye-providing material capable of reacting with oxidized developing agent to provide an imagewise distribution of a diffusible dye;

b. treating said photosensitive element with an alkaline processing composition comprising a silver halide developing agent to effect development of each of said exposed silver halide emulsion layers with a silver halide developing agent, wherein said silver halide developing agent is in reactive association with a positively charged inert transition metal ion complex oxidizing agent capable of having at least two valence states and having a coordination number of 6, which undergoes imagewise redox reaction with said develing agent in areas where metallic silver develops and which is substantially inert in areas where there is no metallic silver;

c. providing an imagewise distribution of diffusible image dye-providing material as a function of said imagewise exposure of each said silver halide emulsion layer; and d. diffusing at least a portion of each said imagewise distributions of diffusible dye to said image-receiving layer.

24. The process of claim 23 wherein the photosensitive portion of said photosensitive element comprises a red-sensitive silver halide emulsion layer having associated therewith a cyan image dye-providing material comprising a nondiffusible coupler capable of reacting with oxidized aromatic primary amino color-developing agent to produce a diffusible cyan dye, a green-sensitive silver halide emulsion layer having associated therewith a magenta image dye-providing material comprising a nondiffusible coupler capable of reacting with oxidized aromatic primary amino color-developing agent to produce a diffusible magenta dye, and a blue-sensitive silver halide emulsion layer having associated therewith a yellow image dye-providing material comprising a nondiffusible coupler capable of reacting with oxidized aromatic primary amino color-developing agent to produce a diffusible yellow dye, said transition metal ion complex being a cobalt complex having a coordination number of 6.

25. The process of claim 24 wherein said cobalt complex is cobalt hexammine(III) chloride.

26. In a process for providing an image record in an imagewise-exposed image-transfer film unit which contains (a) a photographic element comprising a support having thereon at least one layer containing an image-recording means capable of providing an imagewise distribution of a catalytic material which is a zero valent metal or chalcogen of a Group VIII or 1B element and which has associated therewith an image dye-providing material having the formula:

Q-(Imagant)

wherein Imagant is an image dye or image-dye precursor and Q is a silver halide developing agent or an oxidizable releasing group, (b) an image-receiving layer, and (c) means for discharging an alkaline processing within said film unit, wherein said process comprises forming said imagewise distribution of said catalytic material and providing an imagewise distribution of said catalytic material and providing an imagewise distribution of diffusible dye material from said image dye-providing material which is transferred to said image-receiving layer to provide an image record therein, the improvement wherein (1) a reducing agent, which in its oxidized form will react with said image dye-providing material, and (2) a positively charged inert transition metal ion complex oxidizing agent capable of having at least two valence states and having a coordination number of 6, which undergo redox reaction in the presence of a catalytic material which is a zero valent metal or a chalcogen of a Group VIII or 1B element and are substantially inert in the absence of said zero valent metal or chalcogen, are present in said film unit, and undergo redox reaction in the presence of said catalytic material and said image dye-providing material.

27. A process according to claim 26 wherein said inert transition metal complex is a cobalt(III) complex with a net positive charge of 3.

* * * * *

UNITED STATES PATENT AND TRADEMARK OFFICE

CERTIFICATE OF CORRECTION

PATENT NO. : 4,002,477

DATED : January 11, 1977

INVENTOR(S) : Vernon Leon Bissonette

It is certified that error appears in the above-identified patent and that said Letters Patent are hereby corrected as shown below:

Title page, column 1, item [75], "Brookport" should read --Brockport--; item [56], line 7, "Pippel" should read --Dippel--. Column 2, line 1, "contaning" should read --containing--; line 64, "photograhic" should read --photographic--. Column 3, line 46, "the" should read --an--. Column 6, line 24, "Chemists" should read --chemists--; line 53, "mtal" should read --metal--. Column 7, line 10, "o" should read --of--; line 35, "metals of" should read --metals or--; line 48, "thoe" should read --those --. Column 10, line 4, "copper" should read --copper,--; line 5, "a" should read --as--. Column 22, lines 25-34, the formula reading:

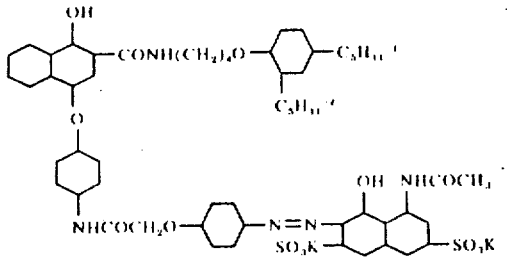

should read

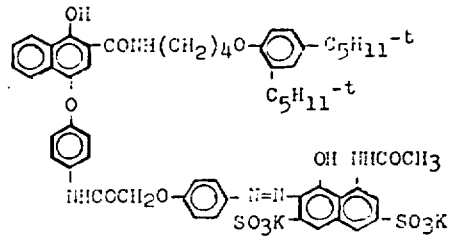

UNITED STATES PATENT AND TRADEMARK OFFICE

CERTIFICATE OF CORRECTION

PATENT NO. : 4,002,477

DATED : January 11, 1977

INVENTOR(S) : Vernon Leon Bissonette

It is certified that error appears in the above-identified patent and that said Letters Patent are hereby corrected as shown below:

Column 24, lines 20-24, the formula reading:

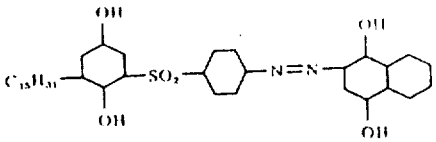

should read

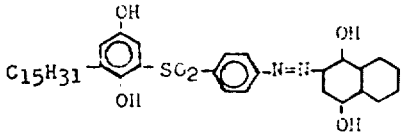

Column 25, line 17, "photograhed" should read --photographed--; lines 34-43, the formula reading:

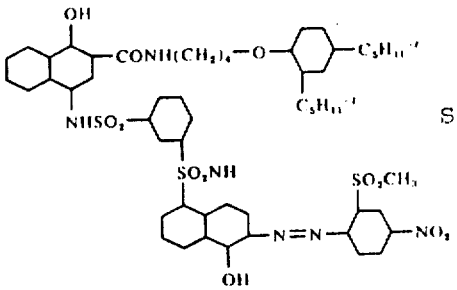

should read

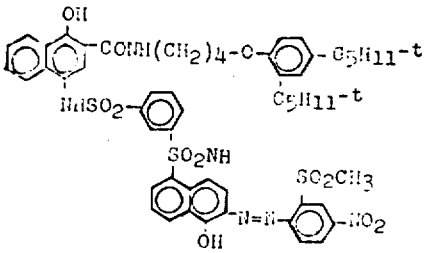

line 50, "photograhic" should read --photographic--. Column 26, lines 11-21, the formula reading:

UNITED STATES PATENT AND TRADEMARK OFFICE

CERTIFICATE OF CORRECTION

PATENT NO. : 4,002,477

DATED : January 11, 1977

INVENTOR(S) : Vernon Leon Bissonette

It is certified that error appears in the above-identified patent and that said Letters Patent are hereby corrected as shown below:

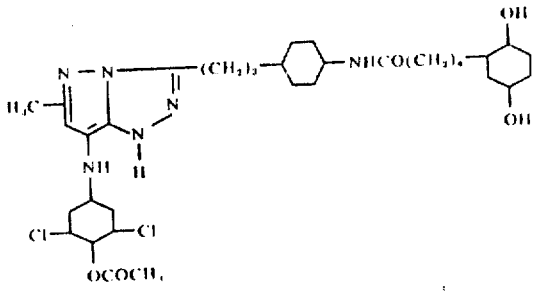

should read

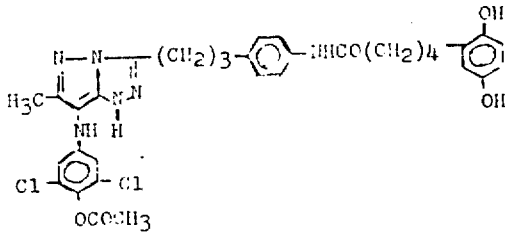

Column 26, line 45, that part of formula reading "]Co" should read --[Co--. Column 27, line 15, "photograhic" should read --photographic--. Column 28, line 26, "dye-providng" should read --dye-providing--.

Signed and Sealed this

Nineteenth Day of April 1977

[SEAL]

*Attest:*

RUTH C. MASON
*Attesting Officer*

C. MARSHALL DANN
*Commissioner of Patents and Trademarks*